US010974867B2

(12) United States Patent
Schalk

(10) Patent No.: US 10,974,867 B2
(45) Date of Patent: Apr. 13, 2021

(54) ANTI-TILTING DEVICE

(71) Applicant: Sprick GmbH Bielefelder Papier-und Wellpappenwerke & Co., Bielefeld (DE)

(72) Inventor: Bastian Schalk, Detmold (DE)

(73) Assignee: SPRICK GMBH BIELEFELDER PAPIER-UND WELLPAPPENWERKE & CO., Bielefeld (DE)

( * ) Notice: Subject to any disclaimer, the term of this patent is extended or adjusted under 35 U.S.C. 154(b) by 0 days.

(21) Appl. No.: 16/085,204

(22) PCT Filed: Mar. 16, 2017

(86) PCT No.: PCT/EP2017/056285
§ 371 (c)(1),
(2) Date: Sep. 14, 2018

(87) PCT Pub. No.: WO2017/158115
PCT Pub. Date: Sep. 21, 2017

(65) Prior Publication Data

US 2019/0023453 A1 Jan. 24, 2019

(30) Foreign Application Priority Data

Mar. 16, 2016 (DE) ..... 10 2016 104 861.5

(51) Int. Cl.
*B65D 19/38* (2006.01)
*B65D 19/44* (2006.01)

(52) U.S. Cl.
CPC ..... *B65D 19/385* (2013.01); *B65D 19/44* (2013.01); *B65D 2519/0081* (2013.01); *B65D 2519/00815* (2013.01)

(58) Field of Classification Search
CPC .. B65D 2519/0081; B65D 2519/00815; B65D 19/385; B65D 19/44
(Continued)

(56) References Cited

U.S. PATENT DOCUMENTS 1,142,088 A * 6/1915 Greene ..... B62B 1/14 414/446
2,412,184 A * 12/1946 Bronislaus ..... B65D 19/0038 108/52.1

(Continued)

FOREIGN PATENT DOCUMENTS

BE 1 011 601 A6 11/1999
CH 653 306 A5 12/1985

(Continued)

*Primary Examiner* — Daniel J Troy
*Assistant Examiner* — Timothy M Ayres
(74) *Attorney, Agent, or Firm* — BakerHostetler

(57) ABSTRACT

An anti-tilting device for releasably mounting on a transport pallet, such as a standardized transport pallet, such as a Euro pallet, is disclosed. The pallet—has a support side for placing the transport pallet on the ground and rest side opposite with respect to the support side, on which the transport goods are to be deposited and which is particularly formed by a plurality of parallel horizontal rest panels spaced apart from each other. The device includes a support pillar and a ground support connected with the support pillar, which extends along the transport pallet height downwards to the ground and which comprises a support end facing the ground for retaining on the ground, and a tine section fixedly connected with the support pillar and the ground support for reaching under the transport goods and particularly for engaging between the rest panels.

20 Claims, 2 Drawing Sheets

(58) Field of Classification Search
USPC ..... 108/53.1–53.5
See application file for complete search history.

(56) References Cited

U.S. PATENT DOCUMENTS

| | | | | | |
|---|---|---|---|---|---|
| 2,509,682 | A * | 5/1950 | Golrick | B65D 19/0034 | 108/52.1 |
| 2,896,799 | A * | 7/1959 | McIntosh | B65D 19/385 | 206/503 |
| 2,926,792 | A * | 3/1960 | Seiz | B65D 19/16 | 108/53.5 |
| 2,942,826 | A * | 6/1960 | De Pew | B65D 19/385 | 108/53.5 |
| 2,994,500 | A * | 8/1961 | Fraser | B65D 19/385 | 108/53.5 |
| 3,091,195 | A * | 5/1963 | Kenyon | B65D 19/06 | 108/53.5 |
| 3,380,404 | A * | 4/1968 | Shell | B65D 19/0081 | 108/52.1 |
| 3,994,241 | A * | 11/1976 | Evans | B65D 19/385 | 108/53.5 |
| 4,147,112 | A * | 4/1979 | Green | B60P 7/08 | 410/94 |
| 4,743,151 | A * | 5/1988 | Haberkorn | B60P 7/14 | 410/121 |
| 5,636,952 | A * | 6/1997 | Richardson | B60P 7/0892 | 410/121 |
| 6,302,034 | B1 * | 10/2001 | Swanson | B65D 19/44 | 108/55.1 |
| 9,227,758 | B2 * | 1/2016 | Maiworm | B65D 19/385 | |
| 9,994,359 | B2 * | 6/2018 | Hansen | B65D 19/385 | |
| 10,029,820 | B2 * | 7/2018 | Van Doorn | B65D 19/385 | |
| 2006/0182620 | A1 * | 8/2006 | Guidroz | B65D 71/0088 | 414/814 |
| 2013/0284687 | A1 | 10/2013 | Maiworm et al. | | |
| 2016/0257446 | A1 * | 9/2016 | Sperling | B65D 19/0026 | |

FOREIGN PATENT DOCUMENTS

| | | | |
|---|---|---|---|
| DE | 81 37 577 | U1 | 5/1982 |
| DE | 36 31 737 | A1 | 4/1988 |
| DE | 295 17 203 | U1 | 12/1995 |
| DE | 10 2005 051347 | B3 | 2/2007 |
| DE | 10 2010 000535 | A1 | 8/2011 |
| DE | 20 2011 052 067 | U1 | 2/2013 |
| EP | 1 454 834 | A1 | 9/2004 |
| FR | 2573389 | * | 11/1984 |
| FR | 2581972 | * | 3/1985 |
| WO | 2015/180870 | A1 | 12/2015 |

* cited by examiner

ANTI-TILTING DEVICE

CROSS-REFERENCE TO RELATED APPLICATIONS

This application is a National Stage of International Patent App No. PCT/EP2017/056285, filed Mar. 16, 2017, which claims priority to German Patent App. No. DE 10 2016 104 861.5, filed Mar. 16, 2016, the disclosures of which are incorporated by reference in their entirety.

FIELD OF THE INVENTION

The invention relates to an anti-tilting device for releasably mounting on or accessing a transport pallet, such as a standardized transport pallet, such as for example a Euro pallet. Standardized transport pallets are certified for example in Europe under the registered trademark EPAL by the European Pallet Association e.V. There are also types of standardized pallets, such as industry pallets or Asia pallets, which have their own dimension specifications, which have formed part of the disclosure of the present application documents.

BACKGROUND

From DE 20 2011 052 067 U1, a transportation safety device for mounting barrels onto a transport pallet is known, where a panel device is applied onto the barrels and which comprises cuts provided at the circumferential surfaces in order to brace the panel device and transport pallet against each other by means of tension strips such that the barrels are fixed on a transport pallet. Securing transport goods in this way is, however, very time consuming and requires additionally to the panel device specific tension strip devices for the assembly. The tension trip device may only be used for rigid transport goods, such as barrels. A tension strip device is unsuitable for easily damageable transport goods.

DE 36 31 737 A1 describes a device for supporting goods of different shapes and dimensions on pallets. Adjusting bars are arranged in a longitudinal gap between the seat boards forming the upper side of the pallet. The adjusting bar comprises supporting blocks against which the transport goods may be moved whereby they are removable in the longitudinal direction of the adjusting bars and parallel to the loading area of the pallet. The adjusting bars are to be arranged on the pallet before loading the transport pallet.

DE 295 17 203 U1 relates to a device for fixing stacked plate-like objects on a transport pallet, which comprises two tensioning elements being movable with regard to each other and surrounding the plate-like objects and the carrier, wherein the tensioning elements are cooperatingly connected with each other in order to apply a clamping force on the surrounded objects. Such a device is however, not suitable to support sensitive transport goods. Further, this sort of securing involves a complicated assembly and requires additionally a device for moving the tensioning elements and for applying the clamping force.

According to G 81 37 577 U1, a stacking pallet for storing stacks of paper web is known, which comprises lateral supports in the shape of short columns which are arranged around the paper stacks in order to prevent shifting of the stacks. Such supporting elements of low height are not suitable for securing the stack against falling over.

SUMMARY OF THE INVENTION

It is an object of the invention to overcome the disadvantages of the state of the art, in particular to provide a support pillar for releasably accessing a particularly standardized transport pallet with which an easy and fast to assemble supporting of the transport goods stored on the pallet is achieved, wherein particularly sensitive transport goods, such as paper tacks, shall not be damaged due to support forces and/or the transport pallet is already occupied with the transport goods.

This object is solved by the features of claim 1.

According to claim 1, an anti-tilting device being separate from the transport pallet for releasably mounting on or accessing a transport pallet is provided. The transport pallet comprises a support side for placing onto the ground and a rest side arranged diametrically opposite with regard to the support side and being oriented preferably parallel thereto, onto which the transport goods are to be deposited and which is formed by a plurality of horizontal rest panels, such as rest boards, being parallel and spaced to each other. Normally, the distance of the rest panels is standardized and shall be referred to as rest panel spacing. Preferably, the transport pallets are made of wood such that upon pressure load they may yield for an admissible deformation without affecting the functionality of the transport pallet. The transport pallet cooperating with the anti-tilting device may be a standardized transport pallet, such as a Euro pallet, which may be certified according to the EPAL and/or registered. It shall be clear that also future transport pallets may cooperate with the anti-tilting device according to the invention. The anti-tilting device serves to provide a railing function or laterally holding the transport goods when attached to the transport pallet, wherein the anti-tilting device shall be moved together with the transport pallet to prevent rolling or tilting over of the transport goods, but not necessarily has to be permanently fixed to the transport pallet, rather, has to be easily accessible and detachable such that the transport goods when loading the transport pallet may reach the rest side of the transport pallet unhinderedly. Additionally, the anti-tilting device shall serve to carefully deposit the transport goods onto the transport pallet and to easily lift therefrom, preferably for a few centimeters, such as 1 to 10 cm, in order to push or pull the transport pallet below the lifted transport goods potentially. In so far, the anti-tilting device according to the invention not only serves to ensure a tilting or falling protection for the transport goods on the transport pallet but also when loading and unloading the transport pallet to lift and put down the transport goods. The anti-tilting device has an operation state in which the anti-tilting device has accessed the transport pallet, in particular exclusively under the influence of the weight of the transport goods is clamped with regard to the transport pallet, in order to particularly meet both above-described functions. The anti-tilting device also has a storing state in which the anti-tilting device may be stored separately from the transport pallet. The operation state is preferably configured such that the anti-tilting device is mounted on the transport pallet without any additional fastening element, such as clamping, screwing, etc. For this purpose, exclusively clamping and holding forces are used which result under the influence of weight of the transport goods themselves and the anti-tilting device.

The anti-tilting device according to the invention comprises a support pillar which in the operation state extends above the transport pallet particularly essentially upwards with regard to the rest side. The support pillar shall be configured so long that it extends over at least 30 cm above the rest side upwards in order to receive lateral tilting forces even of bigger transport goods. Preferably, the support pillar extends over 50, 60, 70, 80 or 100 cm above the rest side, wherein particularly the support pillar height shall be smaller than 110 cm. In particular, the support pillar may comprise a support side facing the transport goods, which is essentially planar and/or two-dimensional. For example, the support pillar may comprise an extensive plate-shaped or a bar-shaped frame structure where the frame bars define the planar support side. The anti-tilting device according to the invention is especially suitable when the transport goods equal a paper stack, in particular a Leporello-folded paper stack, which due to its folding comprises a specific direction of inclination. In this regard, it is advantageous that the paper stack comprises a planar base side with which the anti-tilting device may cooperate advantageously upon clamping or jamming. In particular, the support pillar is configured to receive a cuboid-shaped paper stack with an essentially vertical flat stack side. The support pillar is form-fitted with regard to the flat cuboid side. Further, the anti-tilting device according to the invention comprises a ground support extending downwards from the support pillar along the transport pallet height and having a support end facing the ground for a support on the ground. The transport pallet height is determined by the vertical distance between the rest side and the support side of the transport pallet. Further, the anti-tilting device according to the invention comprises a tine section mounted on the transport pillar as well as on the ground support for reaching under the transport goods and for engaging the rest panel spacing, which is laterally limited by adjacent rest panels and vertically beneath by a base bar of the transport pallet, which fixedly couples the rest panels with each other. Vertically above, the rest panel spacing is open and is covered by the transport goods, in particular the paper stack.

Preferably, the vertical thickness of the tine section is preferably dimensionally adapted with regard to the vertical height of the rest panel gaps preferably such that the tine section may be inserted into the rest panel spacing when the transport pallet is already occupied with transport goods, such as the paper stack, in particular without causing a lifting of the transport goods, or at least only sectionwisely lift the stacks in the area of the tine section without lifting the center of gravity of the stack, and/or such that the tine section is clamped or jammed due to the weight of the transport goods. In this regard, the invention uses the ductility of the transport goods, in particular of the paper stack, which pressingly adapts its shape to the protruding tine section or the recessed tine section.

In the operation state, the tine section preferably horizontally extends. The tine section may essentially vertically extend from the support pillar and the ground support. In this regard, the tine section in proportion to the rest panel spacing may be dimensioned such that upon putting down the tine section on the base bar of the transport pallet, the tine section is braced or tensioned under the influence of the weight of the overlying transport goods with the transport pallet. In this way, the anti-tilting device is supported so that the transport pallet without the need of any additional fastening elements. By means of the ground support and the support end the transport goods may easily be lifted from the rest side of the transport pallet upon a corresponding lever-contact with the ground as soon as the anti-tilting device upon actuation of the support pillar with regard to the lifting-pivoting axis at the contact point of the support end with the ground.

In particular, the tine section is spaced from the support end in the vertical direction such that upon engagement of the tine sections between the rest panels the lever contact of the support end with the ground accompanies or at least the minimal distance of less than 5 cm, preferably less than 3 cm or 1 cm, exists. The tine section which lies between the rest plates in the operation state of the anti-tilting device is clamped by the transport goods with the transport pallet in order to define the anti-tilting device in the operation state at the transport pallet, and on the other hand as lifting device if the supporting end functions as a lever joint upon lever contact with the ground. If a user manually applies tilting forces to the support pillar the tine section and the transport goods lying thereon may be lifted by means of the support end functioning as a pivoting joint. Additionally, the tine section serves as tilting stop of the anti-tilting device. Upon falling over of the transport goods the dead weight of the transport goods in cooperation with the tine section is prevented from laterally falling over or tilting in spite of losing balance.

Slightly reaching under of the tine section and thus easily locking or fixing the anti-tilting device to the transport pallet may structurally be realized in that the tines of the tine section are dimensioned slightly thinner or as thick as or slightly thicker, preferably at least 10 mm or 5 mm thicker, than the thickness of the rest panels of the transport pallet lying on top of the base bar, in particular smaller than 3 cm or 2 cm, preferably between 1 cm and 4 cm. In particular, the tines of the tine section may taper in the direction of their ends such that reaching under or pushing below the transport goods without damaging the latter is possible. The tapering shape of the respective tine section equals a correspondingly-shaped fork structure. Preferably, the tine section comprises exactly two tines. It appeared that a deformable material, such as wood, is advantageous for the base bar and the rest panels of the transport pallet in so far as inserting the tine section in particular when the tines are slightly over-dimensioned or oversized a deformation of the pallet is allowed without affecting its functionality. Due to the measure according to the invention, the tine section may preferably correspondingly-shaped engage the spacing on the rest side and directly below the underside of the transport goods. In case of tilting forces of the transport goods acting on the support pillar a holding counterforce due to the blockade of the weight of the transport goods against swinging upwards of the tine section is directly achieved. In this way, the support pillar holds itself at the transport pallet by using the weight of the transport goods. The anti-tilting device according to the invention for arranging at the transport pallet may be used to securely and reliably store and transport paper stack stocks being often available in cuboid-shaped endless paper web stacks with a Leporello folding.

The anti-tilting device comprises a metal frame.

The design of the anti-tilting device ensures fast attachment to a transport pallet, in particular at a base side. In the mounted state the support pillar is configured to secure transport goods, such as paper stacks, stored on the transport pallet against falling over in particular along the entire height of the transport goods. If the transport goods tend to tilt, for example in that an upper third of the paper stack slides away from the rest of the paper stack, the support pillar serves to laterally hold the tilting or falling part of the paper stack. The tine section reaches under the paper stack and is able to carry or hold the entire weight of the paper stack. In this way, the weight of the paper stack generates a force essentially perpendicularly downwards-directed onto the tine section, which acts against the torque of the part of the paper stack which tends to tilt or fall over. Therefore, the described anti-tilting device is able to support without the need of clamping or tensioning or stretching elements.

Further, it is ensured that the transport goods are not damaged. Furthermore, the support pillar according to the invention does not need a motor or any other device for moving the support pillar and/or the tine section. The support pillar is configured such that a user may bring the support pillar into an engagement and mounting state with the transport pallet even without machine assistance by only inserting the tine section into the spacing between the rest panels until the ground support laterally engages the outer side of the transport pallet. In order to prevent a damage of the transport goods by the swinging up of the tine section a slight distance of the support end of the ground support or an already existing contact on assembling the anti-tilting device with the ground is provided because the ground support define a pivotal limit or stop of the anti-tilting device. In this way, the tilting forces being transferred from the transport goods to the support pillar are transferred from the ground support to the ground whereby the transport goods are not subject to the tilting forces.

In a preferred embodiment of the invention, the anti-tilting device is attachable to or may access the transport pallet which is already occupied with the transport goods such that the anti-tilting device preferably exclusively under the influence of the weight of the transport goods lying on the transport pallet is fixed, in particular clamped, and/or which is carried by the transport pallet at the anti-tilting device for further transportation of the transport pallet together with the transport goods. In order to dock or attach the anti-tilting device to the transport pallet it is not necessary to unload the transport goods from the transport pallet. Additionally or alternatively, the tine section, in particular its tines, may be dimensioned such that the transport goods deposited on the transport pallet braces or tensions the tine section with the transport pallet such that the anti-tilting device is preferably removably attached to the transport pallet and/or is detachable from the transport pallet in particular without removing any further fastening means upon unloading of the transport pallet. Additionally, or alternatively, the support end contacts the ground or is arranged with a minimal spacing with regard to the ground in the attached or docked state of the anti-tilting device such that upon tilting of the support pillar the support end contacting the ground forms a lever pivot bearing axis in order to allow the tine section to swing upwards with a vertical swinging direction upon a tilting movement of the support pillar.

In a further embodiment of the invention, the tine section extends from the support pillar section and the ground support section by forming an angle between 85° and 95°. Thus, in the mounted state of the support pillar it is ensured that the tine section and the rest of the transport pallet, in particular the transport goods deposited thereon, are directed parallel to each other in the direction of extension of the tine section.

Preferably, the tine section comprises a fork structure with at least two tines, preferably exactly two tines, wherein the at least two tines extend parallel to each other from the support pillar section and the ground support section, wherein particularly a tine distance between two tines is at least 145 mm and at the most 205 mm. The fork structure enables simultaneously reaching under the transport goods as well as engaging between rest longitudinal panels being spaced apart from each other of the transport pallet. Alternatively, the tine section may comprise a shovel structure with an essentially thin-walled planar plate which essentially perpendicularly extends from the support pillar section and the ground support section for reaching under for example transport goods stored on a transport pallet.

Preferably, a distance considered in the direction of the pillar of the support end from the tine section preferably essentially perpendicularly extending from the ground support section is slightly shorter than a pallet height which is measured from the ground underside to the transport upper side of the transport pallet. For example, the pallet height of a standardized EPAL-pallet is 144 mm. In particular, the distance of the support end from the tine section is in the range of 150 mm, preferably 140 mm, and 90 mm, preferably 100 mm. By adapting the geometric dimensions of the support pillar, in particular the distance between the support end and the tine section, a damage-free reaching under the transport goods is ensured. The tine distance of two tines is also aligned with respect to the standardized transport pallet such that the tines may be inserted into spacings between the rest panels spaced apart from each other.

In a preferred embodiment of the support pillar, the supporting pillar section comprises two vertical struts extending parallel to each other. Preferably, at the upper vertical strut ends an upper reinforcement cross member is attached, wherein particularly the bottom of the support section is formed by an extension of the respective vertical struts beyond the vertical height of the tine section. In this regard, at the lower ends of the vertical struts a reinforcement cross member for forming the support end is formed such that the ground support and the support pillar section form a closed strut frame, wherein particularly at a predetermined vertical height the tine section essentially perpendicularly extends away from the pillar frame. A further intermediate cross member arranged at the vertical height of the tine section may be configured to connect the two vertical struts. It shall be clear that the further intermediate cross member does not necessarily have to be arranged at the vertical height of the tine section. Preferably, two intermediate cross members transversely extending and preferably crossing in the middle of the support pillar for stabilizing the support pillar may be provided.

Preferably, the predetermined vertical height of the tine section is 120 mm, wherein the tine section may be preferably formed by one piece with the support pillar section and the ground support. Preferably, the support pillar is manufactured as a welded part or is mounted by means of fastening means, such as screws.

In a further development of the invention, the tines comprise an essentially constant, preferably rectangular, cross-section along the tine section. Preferably, a ramp-shaped surface may be provided at an end of the tines facing away from the support pillar section to facilitate reaching under the transport goods and inserting the tines into the spacings between the rust paddles. In particular, the angle between the ramp-shaped surface and the direction of extension of the tines is 30°, wherein particularly the tines comprise a tine height in the range of 1 cm to 4 cm or 3 cm, preferably of 15 mm, preferably at the most 20 mm, for example around 15 mm. It shall be clear that further tine heights are possible by adapting the tine heights with regard to the vertical height of the rest panels.

Preferably, the vertical struts and/or the cross members comprise a constant rectangular cross-section, wherein particularly the vertical struts are connected with the cross members vertically, preferably by forming an angle between 85° and 95°.

Alternatively, the vertical struts and/or the cross members may also comprise a circular cross section, wherein it is clear that the geometry of the vertical struts and cross members shall not be limiting and further cross-sections are included in this disclosure.

In a preferred embodiment the overall height of the support pillar is at least 150 mm, preferably 1000 mm, and a width at least 165 mm, in particular less than 225 mm. Preferably, the tine section comprises a length in the direction of extension of at least 150 mm, preferably exactly 300 mm, preferably to realize also a support of transport goods which are not placed directly adjacent the edge of the transport pallet.

According to a further development of the invention, at the upper cross member of the support pillar section at least one, preferably two, through-bores for mounting a handle, such as a bracket handle or bow-type handle, is provided. The handle may be preferably detachably mounted at a backside of the support pillar, which is facing away from the transport pillar, in particular by means of fastening means, such as screws, wherein particularly a distance between the two through-bores is at least 100 mm and the most 200 mm, preferably exactly 112 mm. Alternatively, at the backside of the support pillar, in particular at the upper cross member, at least one blind hole may be provided which is configured to receive the handle, wherein the handle is mounted preferably complementary in shape in the blind hole, such as clipped.

Preferably, the support pillar further comprises a support leg which is arranged at the backside of the support pillar for contacting the ground and facilitating the support of the transport goods. The support leg is preferably configured as a thin-walled plate and extends essentially perpendicularly, preferably by forming an angle between 85° and 95°, with regard to the ground support away from the support end. Alternatively, at each of both vertical struts a support leg may be attached such that the support legs in a mounted state of the support pillar contact the ground, wherein the support legs extend from the ground support section or the support pillar section preferably in an angle of at least 45°.

In a further development of the support pillar, at least one reinforcement rib is provided between the ground support section and the tine section for reinforcing the support pillar. The reinforcement rib is preferably arranged in an angle of 45°, preferably by forming an angle between 30° and 60°, and may preferably comprise the same cross-section as the vertical struts and/or the cross members.

BRIEF DESCRIPTION OF THE DRAWINGS

In the following, further characteristics, features and advantages of the invention become apparent by means of the description of preferred embodiments of the invention by means of the accompanying Figures, in which.

DETAILED DESCRIPTION

Figure 1:
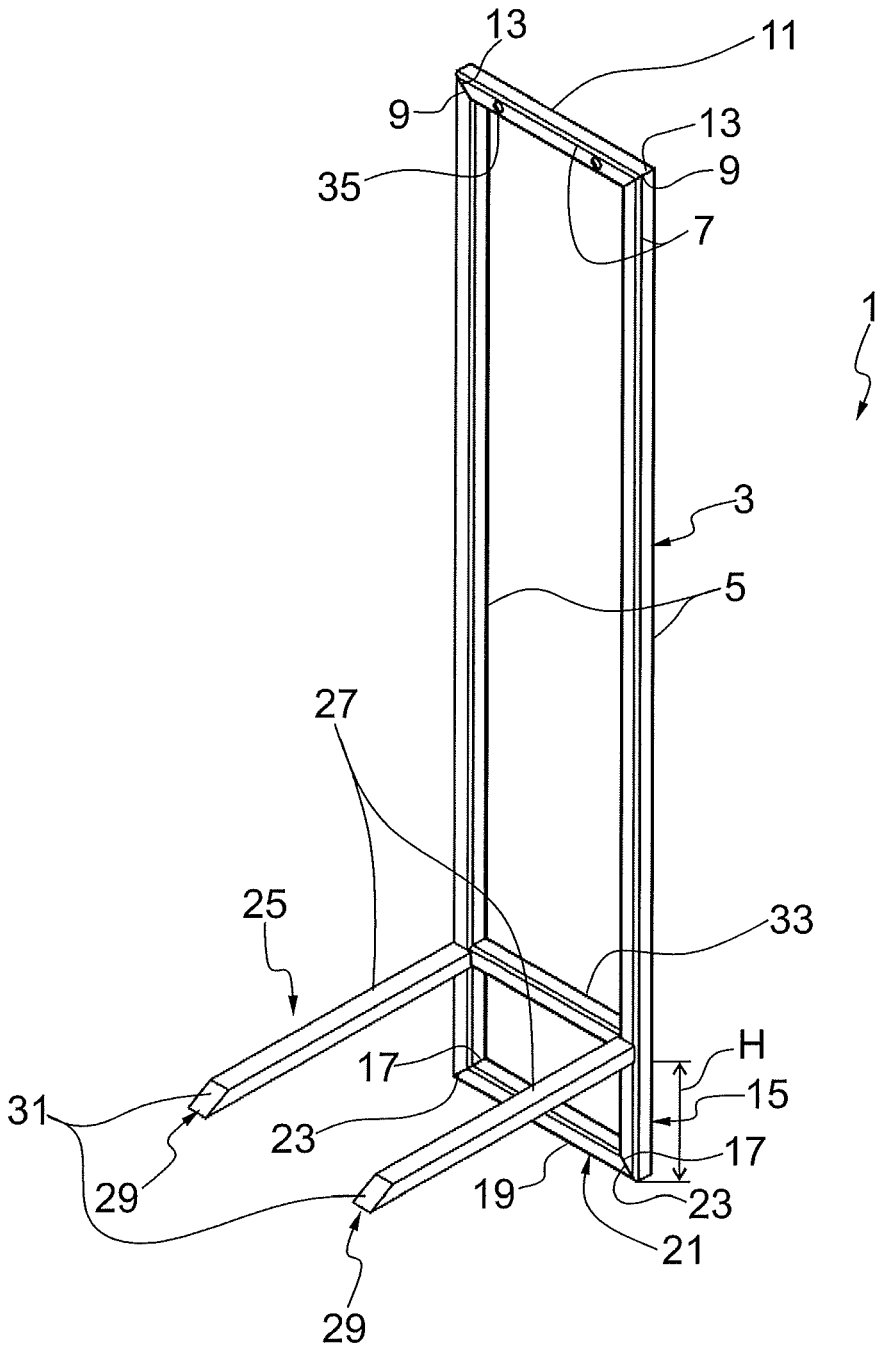
FIG. 1 shows a perspective view of a support pillar according to the invention for releasably attaching to a standardized transport pallet.
Figure 2:
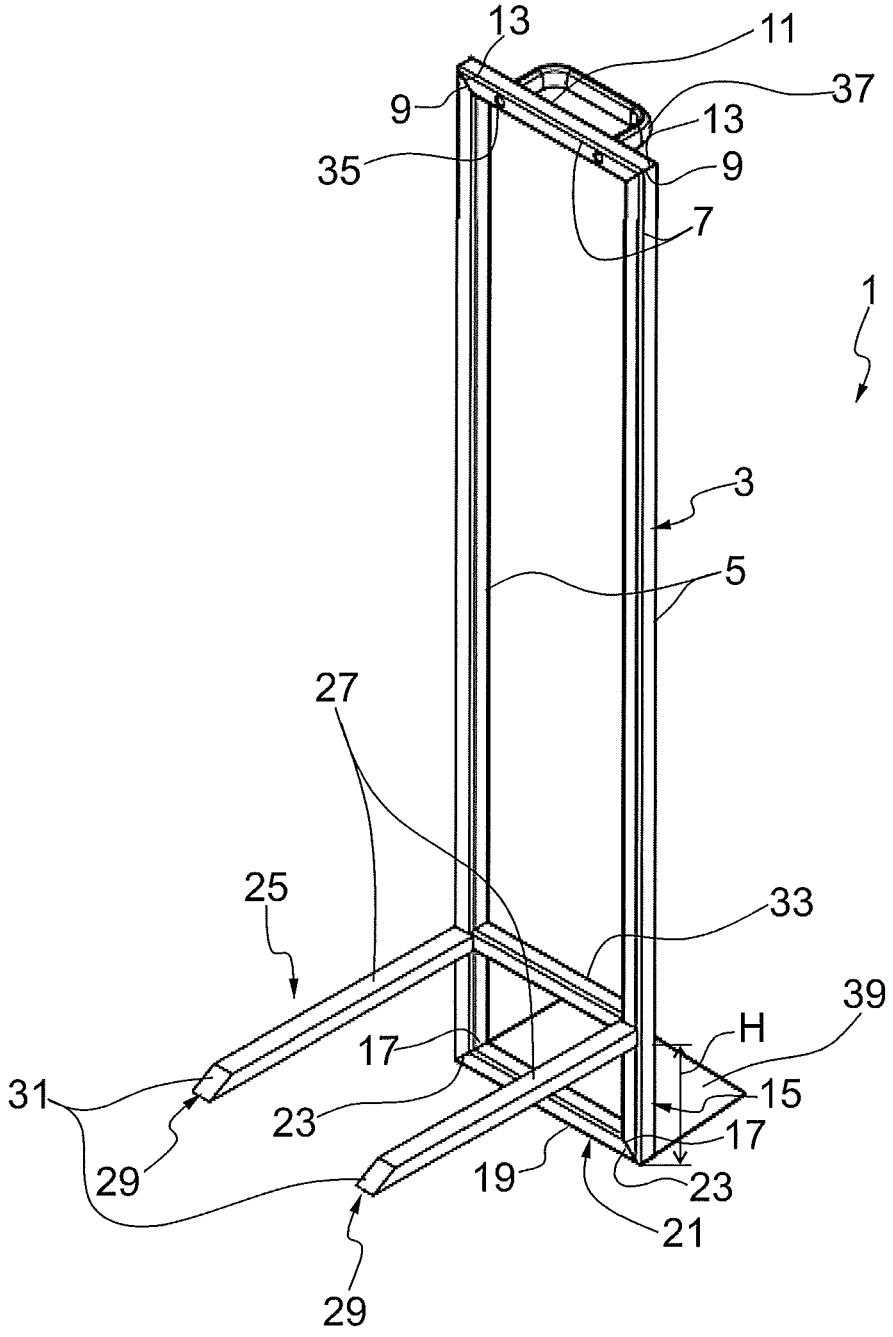
FIG. 2 shows a perspective view of a support pillar according to FIG. 1, wherein furthermore a handle and a support leg are provided on the support pillar.

In FIGS. 1 and 2 the anti-tilting device according to the invention is generally indicated with the reference sign 1. The anti-tilting device 1 is configured to be releasably attached to a standardized transport pallet (not shown). The anti-tilting device 1 comprises a support pillar of at least 30 mm essentially extending perpendicularly upwards from the transport pallet. In particular, the support pillar 3 extends exactly 880 mm from the transport pallet perpendicularly upwards. In the illustrated embodiments, the support pillar 3 comprises two vertical struts 5 arranged parallel with regard to each other, which essentially comprise the same geometric dimensions as well as the same cross-section. The illustrated vertical struts 5 comprise an essentially rectangular cross-section, wherein edges 7 of the vertical struts 5 are deburred or rounded. At an upper vertical strut end 9 the vertical struts 5 are connected with each other via an upper reinforcement cross member 11 also comprising an essentially rectangular cross-section, in particular except for deburred or rounded edges 7. Further, the reinforcement cross member 11 comprises a reinforcement cross member end 13 at both ends, wherein the reinforcement cross member ends 13 are aligned with respect to the vertical strut ends 9 such that the reinforcement cross member 11 extends essentially perpendicular with regard to both vertical struts 5 and that a protrusion-free passage is formed.

Further, the anti-tilting device 1 comprises a ground support 15 essentially extending perpendicularly downwards from the transport pallet, which is preferably formed by extending the vertical struts 5 downwards in the direction of the ground. Thus, in particular, the passages with regard to the geometry and the dimension of the vertical struts 5 of the support pillar 3 are analogously applicable to the ground support 15. At the lower ends of the vertical struts 5 of the ground support 15, lower vertical strut ends 17 are formed where a lower reinforcement cross member 19 for forming a support end 21 facing the ground is arranged. At the ends of the reinforcement cross member 19 reinforcement cross member ends 23 are provided which are lined with respect to the lower vertical strut ends in accordance with the reinforcement cross member ends 13 such that the reinforcement cross member 19 extends essentially perpendicularly with regard to both vertical struts 5 and a free passage is built. Thus, a closed, in particular rectangular, strut frame is formed.

The anti-tilting device 1 comprises also a tine section 25 for reaching under transport goods deposited on the transport pallet and for engaging between rest panels of the transport pallets arranged in a distance with regard to each other. The tine section 25 extends by forming an angle of around 90° from the support pillar section and the ground support section. In the illustrated embodiments, the tine section 25 is formed as a fork structure and comprises two parallel tines 27 extending from the support pillar section and the ground support section, wherein also more than two tines 27 may be provided. Up to a distal end 29 distant from support pillar 1 the tines 27 comprise an essentially constant, in particular rectangular cross-section, wherein the tine height is 15 mm. At the distal end 29 the tines 27 comprise a ramp-shaped surface 31 inclined about an angle of 30°, which facilitates reaching under the pallet goods. The tine height is adjusted such that the tine section may be inserted into the rest panel spacing even when the transport goods, in particular the paper stack, is deposited on the rest panels. The tine height is dimensioned such that manually inserting is possible. However, the tine height is also to be adjusted such that a jamming of the tine section 25 is achieved because the formability of the paper stack is used to compensate a small oversize of the tine section height with regard to the rest panel spacing height as well as a vertical recess of the tine section 25 with regard to the rest panels of the rest panel spacing. It is, however, clear that further tine geometries are also suitable for the invention. A vertical height H of the tine section 25 comprises preferably 120 mm in order to be adapted to the standardized transport pallet.

Thus, a reliable, without damaging the transport pallets, engaging of the tine section 25 between two rest panels of the transport pallets spaced with regard to each other is ensured. Further, at the predetermined vertical height H of the tine section 25 a further intermediate cross member 33 for connecting the two vertical struts 5 is provided, which comprises an analog geometry such as the vertical struts 5.

The illustrated anti-tilting device 1 is manufactured as a welded part, wherein two vertical struts 5 are welded together with the upper cross member 11, the lower cross member 19 and the intermediate cross member 33 for forming a closed strut frame. Further, the tines 27 forming the tine section 25 are welded together at the predetermined tine height H with the strut frame. A suitable material of the single components may for example be steel. Of course, further combinations of material and assembly processes on the anti-tilting device 1 are possible.

At the upper cross member 11 two through-bores 35 arranged in a distance with regard to each other for receiving and mounting a handle 37 are provided, wherein the distance between the two through-bores 35 in a preferred embodiment is 112 mm. The handle 37 may for example comprise two pins (not shown) which may be inserted into the through-bores 35 and may there be braced or tensioned complementary in shape. Also, it is possible to attach the handle 37 by means of a screwing at the upper cross member 11.

An additional support leg 39 may be arranged at the backside of the support pillar 1 for contacting ground. The support leg 39 may be formed as a thin-walled plate and extends essentially perpendicularly with regard to the ground support 15 away from the support end 21.

The features disclosed in the preceding description, the Figures and the claims may be relevant for the realization of the invention in its different embodiments alone or in any combination.

REFERENCE SIGN LIST

1 anti-tilting device
3 support pillar
5 vertical strut
7 edge
9 vertical strut end
11 reinforcement cross member
13 reinforcement cross member end
15 ground support
17 vertical strut end
19 reinforcement cross member
21 support end
23 reinforcement cross member end
25 tine section
27 tine
29 distal end
31 ramp-shaped surface
33 intermediate cross member
35 through bore
37 handle
39 support leg

The invention claimed is:

1. An anti-tilting device for releasable mounting to a transport pallet, the anti-tilting device comprising:

a support pillar comprising two vertical struts arranged in parallel with regard to each other, having a top end opposite a bottom end, and extending vertically upwards in an operation state with the transport pallet;

a ground support comprising two short vertical struts, a reinforcement cross member, and an intermediate cross member, each short vertical strut arranged in parallel with regard to each other, having a top end opposite a bottom end, and extending vertically downward from the bottom end of a corresponding vertical strut of the support pillar, the reinforcement cross member extending horizontally between the bottom ends of the two short vertical struts for supporting the anti-tilting device on the ground, the intermediate cross member extending horizontally between the top ends of the two short vertical struts in parallel with regard to the reinforcement cross member, and the length of each short vertical strut being less than the length of each vertical strut; and a tine section comprising two tines arranged in parallel with regard to each other and each fixedly extending substantially perpendicularly from the support pillar at the bottom end of the vertical strut and from the ground support at the top end of the short vertical strut above the reinforcement cross member for reaching under transport goods stored on the transport pallet, wherein, when the anti-tilting device is mounted to the transport pallet, the support pillar is configured to secure the transport goods stored on the transport pallet against falling over.

2. The anti-tilting device according to claim 1, wherein the tine section is above the reinforcement cross member in the vertical direction such that, when the device is mounted to the transport pallet, a distance of the reinforcement cross member from the tine section is as big as or slightly smaller than a height of the transport pallet.

3. The anti-tilting device according to claim 2, wherein the distance is between 100 mm and 140 mm.

4. The anti-tilting device according to claim 1, wherein:

the support pillar further comprises an upper reinforcement cross member that couples the two vertical struts, and the support pillar and the ground support are structured such that they thereby form a closed frame.

5. The anti-tilting device according to claim 1, wherein the vertical struts or the cross members of the anti-tilting device comprise a continuously rectangular hollow bar cross-section.

6. The anti-tilting device according to claim 1, wherein:

the two tines are each ramp- or wedge-shaped, the angle between a ramp-shaped upper surface of the tines and a direction of extension of the tines is between 20° and 40°, and the tines comprise a vertical height of at least 15 mm.

7. The anti-tilting device according to claim 1, wherein:

the support pillar comprises a total height of at least 150 mm and less than 1500 mm, a width in a range of 165 mm to 225 mm, and the tine section comprises a length in a direction of extension of at least 150 mm.

8. The anti-tilting device according to claim 1, wherein, at an upper section of the support pillar, at least one through bore for mounting a handle is provided.

9. The anti-tilting device according to claim 8, further comprising a handle mounted to the upper section of the support pillar.

10. The anti-tilting device according to claim 1, wherein a support leg is arranged at the reinforcement cross member, the support leg extending horizontally from the backside of the reinforcement cross member for contacting the ground.

11. The anti-tilting device according to claim 1, wherein, when the anti-tilting device is mounted to the transport pallet, the reinforcement cross member contacts the ground.

12. The anti-tilting device according to claim 11, wherein upon tilting of the support pillar, the reinforcement cross member contacting the ground forms a lever pivot bearing access in order to lift the tine section with an essentially vertical upswinging movement upon a tilting movement of the support pillar.

13. The anti-tilting device according to claim 1, wherein the reinforcement cross member has a flat bottom surface.

14. The anti-tilting device according to claim 1, wherein the two short vertical struts extend along the same two axes as the two vertical struts.

15. The anti-tilting device according to claim 1, wherein the support pillar, the ground support, and the tine section are formed as one piece.

16. The anti-tilting device according to claim 1, wherein each vertical strut and corresponding short vertical strut are formed of the same cross-sectional tubing.

17. The anti-tilting device according to claim 1, wherein the angle between a ramp-shaped upper surface of the tines and a direction of extension of the tines is between 20° and 40°.

18. An anti-tilting device for releasable mounting to a transport pallet, the anti-tilting device comprising:

a support pillar comprising two vertical struts arranged in parallel with regard to each other, having a top end opposite a bottom end, and extending vertically upwards in an operation state with the transport pallet;

a ground support comprising two short vertical struts, a reinforcement cross member, and an intermediate cross member, each short vertical strut arranged in parallel with regard to each other, having a top end opposite a bottom end, and extending vertically downward from the bottom end of a corresponding vertical strut of the support pillar, the reinforcement cross member extending horizontally between the bottom ends of the two short vertical struts for supporting the anti-tilting device on the ground, and the intermediate cross member extending horizontally between the top ends of the two short vertical struts in parallel with regard to the reinforcement cross member; and a tine section comprising two ramp- or wedge-shaped tines arranged in parallel with regard to each other and each fixedly extending substantially perpendicularly from the support pillar at the bottom end of the vertical strut and from the ground support at the top end of the short vertical strut above the reinforcement cross member for reaching under transport goods stored on the transport pallet, wherein the angle between a ramp-shaped upper surface of the tines and a direction of extension of the tines is between 20° and 40°, wherein, when the anti-tilting device is mounted to the transport pallet, the support pillar is configured to secure the transport goods stored on the transport pallet against falling over.

19. The anti-tilting device according to claim 18, wherein the two short vertical struts extend along the same two axes as the two vertical struts.

20. The anti-tilting device according to claim 18, wherein the tine section is above the reinforcement cross member in the vertical direction such that, when the device is mounted to the transport pallet, a distance of the reinforcement cross member from the tine section is as big as or slightly smaller than a height of the transport pallet.

* * * * *